US007652435B2

(12) United States Patent
Kang

(10) Patent No.: US 7,652,435 B2
(45) Date of Patent: Jan. 26, 2010

(54) LAMP DRIVING CIRCUIT AND DISPLAY APPARATUS HAVING THE SAME

(75) Inventor: Moon-Shik Kang, Seongnam-si (KR)

(73) Assignee: Samsung Electronics Co., Ltd. (KR)

( * ) Notice: Subject to any disclaimer, the term of this patent is extended or adjusted under 35 U.S.C. 154(b) by 56 days.

(21) Appl. No.: 11/933,006

(22) Filed: Oct. 31, 2007

(65) Prior Publication Data

US 2008/0137385 A1 Jun. 12, 2008

(30) Foreign Application Priority Data

Nov. 17, 2006 (KR) ..... 10-2006-0113863

(51) Int. Cl.
*H05B 414/24* (2006.01)

(52) U.S. Cl. ..... 315/276; 315/246; 315/277; 315/278

(58) Field of Classification Search ..... 315/194, 315/195, 209 R, 210, 209 T, 246, 247, 250, 315/291, 312, 323, 360, DIG. 2, DIG. 5
See application file for complete search history.

(56) References Cited

U.S. PATENT DOCUMENTS 7,015,658 B2 * 3/2006 Tsay et al. ..... 315/307
2004/0145584 A1 * 7/2004 Lee et al. ..... 345/212

FOREIGN PATENT DOCUMENTS

JP 2004342485 12/2004
JP 2006032158 2/2006
KR 1020060028018 3/2006

* cited by examiner

*Primary Examiner*—Douglas W Owens
*Assistant Examiner*—Jianzi Chen
(74) *Attorney, Agent, or Firm*—Cantor Colburn LLP

(57) ABSTRACT

A lamp driving circuit includes: a first voltage generator which receives a direct current power voltage and outputs a first square wave voltage in response to a first switching signal and a second switching signal having a phase inverted with respect to the first switching signal; a second voltage generator which outputs a second square wave voltage in response to a third switching signal having a phase shifted by a predetermined time with respect to the phase of the first switching signal and a fourth switching signal having a phase inverted with respect to the phase of the third switching signal; and a transformer which receives the first square wave voltage and the second square wave voltage and boosts a first driving voltage defined by an electric potential difference therebetween to a second driving voltage and applies the second driving voltage to a lamp.

11 Claims, 6 Drawing Sheets

LAMP DRIVING CIRCUIT AND DISPLAY APPARATUS HAVING THE SAME

This application claims priority to Korean Patent Application No. 2006-113863, filed on Nov. 17, 2006, and all the benefits accruing therefrom under 35 U.S.C. § 119, the contents of which in its entirety are herein incorporated by reference.

BACKGROUND OF THE INVENTION

1. Field of the Invention

The present invention relates to a lamp driving circuit and a display apparatus having the lamp driving circuit. More particularly, the present invention relates to a lamp driving circuit having a simplified circuit configuration thereof and a display apparatus having the lamp driving circuit.

2. Description of the Related Art

In general, a liquid crystal display ("LCD") includes a backlight assembly which emits a light and a display panel which displays images using the light.

The backlight assembly includes a number of lamps, each of which emits light, and the LCD further includes a lamp driving circuit which drives each of the lamps of the backlight assembly.

The lamp driving circuit generally includes either a push-pull parallel-resonant inverter, a half-bridge serial-resonant inverter or a full-bridge serial-resonant inverter.

The full-bridge serial-resonant inverter includes four times as many switching devices as the number of lamps, and changes a pulse width of a switching signal applied to each switching device, thereby adjusting a voltage applied to a transformer.

However, since the full-bridge serial-resonant inverter includes more switching devices than the push-pull parallel-resonant inverter and the half-bridge serial-resonant inverter, a configuration of the lamp driving circuit employing the full-bridge serial-resonant inverter is more complicated than configurations of lamp driving circuits employing the push-pull parallel-resonant inverter or the half-bridge serial-resonant inverter.

BRIEF SUMMARY OF THE INVENTION

The present invention provides a lamp driving circuit having a simplified circuit configuration and a display apparatus having the lamp driving circuit.

According to exemplary embodiments of the present invention, third and fourth switching signals are shifted with respect to first and second switching signals to generate first and second square wave voltages. A lamp driving circuit boosts the first driving voltage to a second driving voltage based on the first and second square wave voltages and applies the second driving voltage to a lamp. Thus, a number of switching devices required in the lamp driving circuit is effectively reduced.

In an exemplary embodiment of the present invention, a lamp driving circuit includes a first voltage generator, a second voltage generator and a transformer.

The first voltage generator receives a direct current power voltage and outputs a first square wave voltage in response to a first switching signal and a second switching signal, the second switching signal having a phase which is inverted with respect to a phase of the first switching signal.

The second voltage generator receives the direct current power voltage and outputs a second square wave voltage in response to a third switching signal having a phase which is shifted by a predetermined time with respect to the phase of the first switching signal and a fourth switching signal having a phase which is inverted with respect to the phase of the third switching signal.

The transformer receives the first square wave voltage through a first input terminal and the second square wave voltage through a second input terminal and boosts a first driving voltage, defined by an electric potential difference between the first square wave voltage and the second square wave voltage, to generate a second driving voltage having a voltage level higher than a voltage level of the first driving voltage and applies the second driving voltage to a lamp.

The first voltage generator includes a first switching device having an input electrode which receives the direct current power voltage, a control electrode which receives the first switching signal and an output electrode connected to the first input terminal of the transformer. The first voltage generator further includes a second switching device having an input electrode connected to the first input terminal of the transformer, a control electrode which receives the second switching signal and an output electrode connected to a ground voltage terminal to which a ground voltage is applied.

The first voltage generator may further include a first diode having an anode connected to the output electrode of the first switching device and a cathode connected to the input electrode of the first switching device, and a second diode having an anode connected to the output electrode of the second switching device and a cathode connected to the input electrode of the second switching device.

The second voltage generator includes a third switching device having an input electrode which receives the direct current power voltage, a control electrode which receives the third switching signal and an output electrode connected to the second input terminal of the transformer. The second voltage generator further includes a fourth switching device having an input electrode connected to the second input terminal of the transformer, a control electrode which receives the fourth switching signal and an output electrode connected to the ground voltage terminal to which the ground voltage is applied The second voltage generator may further include a third diode having an anode connected to the output electrode of the third switching device and a cathode connected to the input electrode of the third switching device, and a fourth diode having an anode connected to the output electrode of the fourth switching device and a cathode connected to the input electrode of the fourth switching device.

The first switching signal, the second switching signal, the third switching signal and the fourth switching signal each has a duty ratio equal to about 50 percent.

A high period of the first switching signal partially temporally overlaps a high period of the third switching signal, and a high period of the second switching signal partially temporally overlaps a high period of the fourth switching signal.

The first driving voltage includes: an electric potential substantially equal to an electric potential of the direct current power voltage during a first period where the high period of the first switching signal temporally overlaps a low period of the third switching signal; an electric potential having an opposite polarity to the polarity of the direct current power voltage during a second period where a low period of the first switching signal temporally overlaps the high period of the third switching signal; and an electric potential of about zero volts during a third period where the high period of the first switching signal temporally overlaps the high period of the third switching signal and a fourth period where the low period of the first switching signal is overlapped with the low period of the third switching signal.

In another exemplary embodiment of the present invention, a lamp driving circuit includes a first voltage generator, a second voltage generator and a boosting part.

The first voltage generator receives a direct current power voltage and outputs a first square wave voltage through a first output terminal in response to a first switching signal and a second switching signal having a phase which is inverted with respect to a phase of the first switching signal.

The second voltage generator receives the direct current power voltage and outputs n (n≧2) second square wave voltages through corresponding n second output terminals, each n second square wave voltage having a phase different than the phase of the first square wave voltage, in response to n third switching signals shifted by a predetermined time with respect to the phase of the first switching signal, and n fourth switching signals each having a phase which is inverted with respect to a corresponding phase of the n third switching signals.

The boosting part includes n transformers. First input terminals of the n transformers are commonly connected to the first output terminal of the first voltage generator to receive the first square wave voltage. Second input terminals of the n transformers receive the n second square wave voltages from respective n-th second output terminals of the second voltage generator. Thus, the n transformers receive n first driving voltages defined by an electric potential difference between the first square wave voltage and the n second square wave voltages and boost the n first driving voltages to n second driving voltages having higher voltage levels than voltage levels of the n first driving voltages. The boosted n second driving voltages are applied to n lamps.

The n third switching signals each have a phase shifted by a predetermined time with respect to the phase of the first switching signal, and the n fourth switching signals each have a phase which is inverted with respect to a phase of a corresponding n-th third switching signal.

The n first driving voltages each has a pulse width adjusted by a phase difference between a respective n-th third switching signal and the first switching signal.

The first voltage generator includes a first switching device having an input electrode which receives the direct current power voltage, a control electrode which receives the first switching signal and an output electrode connected to each of the n first input terminals of the n transformers of the boosting part. The first voltage generator further includes a second switching device having an input electrode connected to each of the n first input terminals of the n transformers of the boosting part, a control electrode which receives the second switching signal and an output electrode connected to a ground voltage terminal to which a ground voltage is applied.

The second voltage generator includes n third switching devices, each having an input electrode which receives the direct current power voltage, a control electrode which receives a corresponding n-th third switching signal and an output electrode connected to a respective second input terminal of the n transformers of the boosting part. The second voltage generator further includes n fourth switching devices each having an input electrode connected to a respective second input terminal of the n transformers of the boosting part, a control electrode which receives a corresponding n-th fourth switching signal and an output electrode connected to the ground voltage terminal to which the ground voltage is applied.

A high period of the first switching signal partially temporally overlaps a respective high period of each of the n third switching signals and a high period of the second switching signal partially temporally overlaps a respective high period of each of the n fourth switching signals.

A pulse width of the n first driving voltages is determined by a width of a first period where a high period of the first switching signal temporally overlaps a high period of a respective n-th third switching signal and a width of a second period where a high period of the second switching signal temporally overlaps a high period of a respective n-th fourth switching signal.

In another exemplary embodiment of the present invention, a display apparatus includes a backlight assembly including n (n≧1) lamps which each emit a light, a lamp driving circuit which drives the n lamps, and a display panel which receives the light from the backlight assembly to display an image.

The lamp driving circuit includes a first voltage generator, a second voltage generator and a boosting part.

The first voltage generator receives a direct current power voltage and outputs a first square wave voltage through a first output terminal in response to a first switching signal and a second switching signal having a phase which is inverted with respect to a phase of the first switching signal.

The second voltage generator receives the direct current power voltage and outputs n second square wave voltages through corresponding n-th second output terminals, each n second square wave voltage having a phase different than a phase of the first square wave voltage in response to n third switching signals (n is a constant number equal to or larger than 2) shifted by a predetermined time with respect to the phase of the first switching signal, and n fourth switching signals each having a phase which is inverted with respect to a corresponding phase of the n third switching signals.

The boosting part includes n transformers. First input terminals of the n transformers are commonly connected to the first output terminal of the first voltage generator to receive the first square wave voltage. Second input terminals of the n transformers receive n second square wave voltages from respective n-th second output terminals of the second voltage generator. Thus, the n transformers receive n first driving voltages defined by an electric potential difference between the first square wave voltage and the n second square wave voltages and boosts the n first driving voltages to generate n second driving voltages each having a higher voltage level than a voltage level of a corresponding n first driving voltage. The boosted n second driving voltages are applied to the n lamps.

The n third switching signals each have a phase shifted by a predetermined time with respect to the phase of the first switching signal, and the n fourth switching signals each have a phase which is inverted with respect to a phase of a corresponding n-th third switching signal.

A high period of the first switching signal partially temporally overlaps a respective high period of each of the n third switching signals, and a high period of the second switching signal partially temporally overlaps a respective high period of each of the n fourth switching signals. A pulse width of each of the first driving voltages is determined by a width of a first period where a high period of the first switching signal temporally overlaps a high period of a respective n-th third switching signal and a width of a second period where a high period of the second switching signal temporally overlaps a high period of a respective n-th fourth switching signal.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
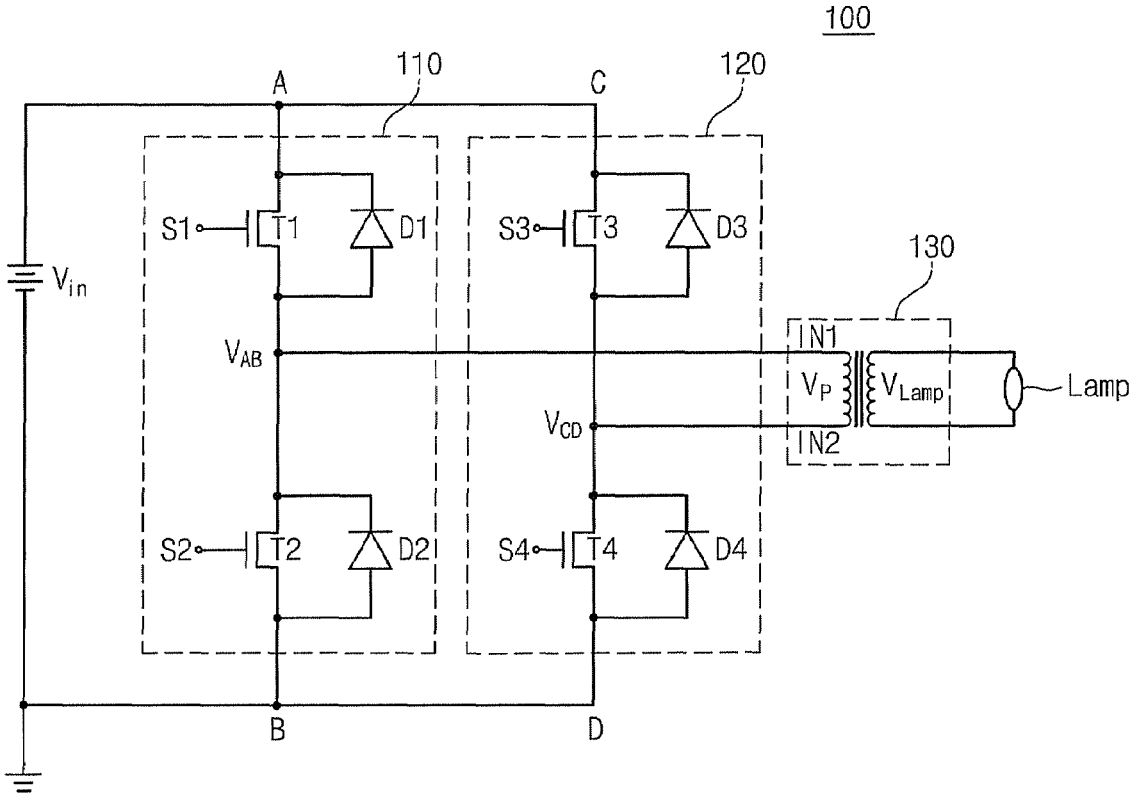
FIG. 1 is a schematic circuit diagram of a lamp driving circuit according an exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

Figure 2:
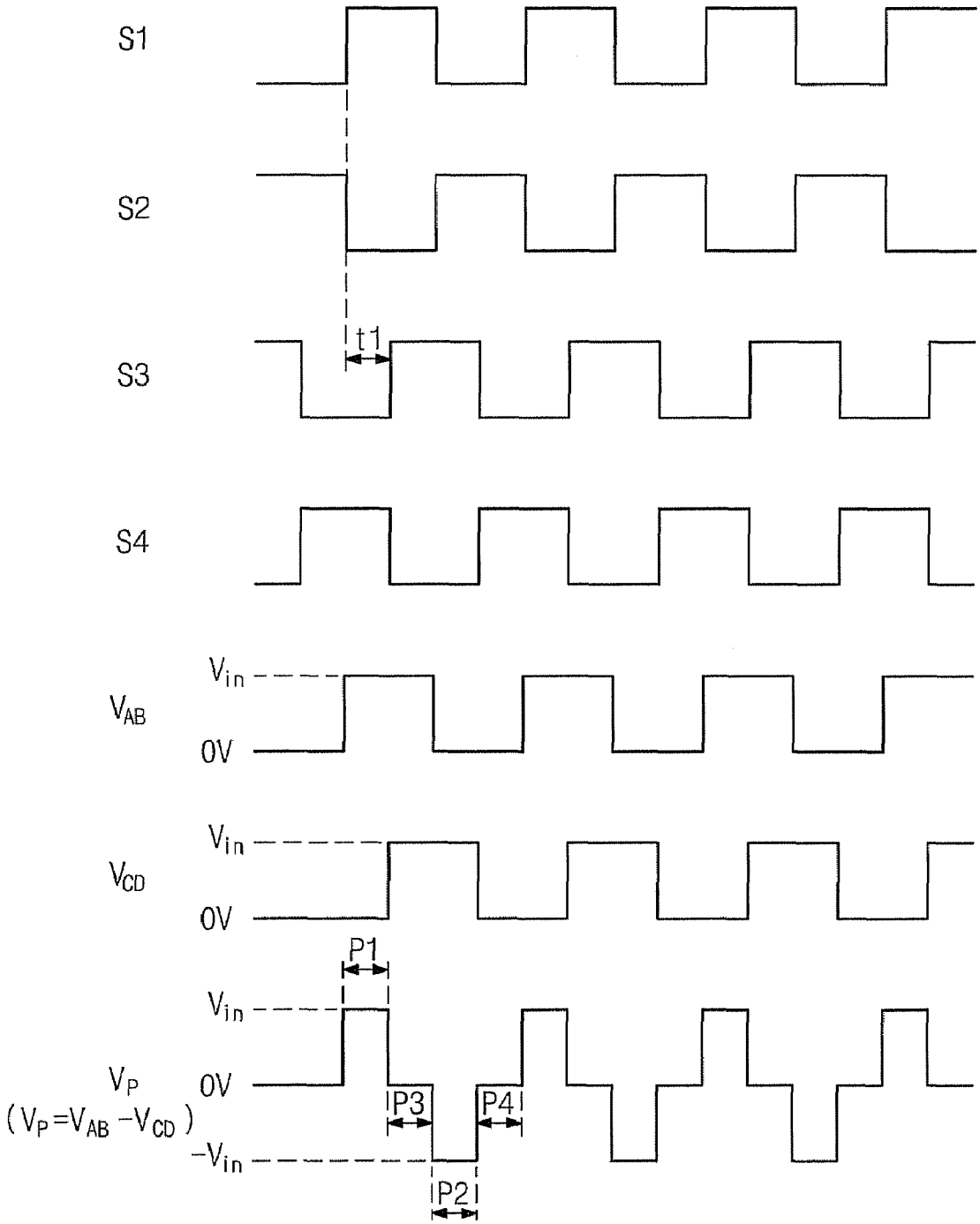
FIG. 2 is a waveform timing diagram showing switching signals, square wave voltages and a first driving voltage of a lamp driving circuit according the exemplary embodiment of the present invention FIG. 1.

FIG. 1 is a schematic circuit diagram of a lamp driving circuit according to an exemplary embodiment of present invention, and FIG. 2 is a waveform timing diagram showing switching signals, square wave voltages and a first driving voltage of a lamp driving circuit according the exemplary embodiment of the present invention FIG. 1.

Referring to FIG. 1, a lamp driving circuit 100 includes a first voltage generator 110, a second voltage generator 120 and a transformer 130.

The first voltage generator 110 converts a direct current power voltage $V_{in}$ from an outside source (not shown) to a first square wave voltage $V_{AB}$ in response to a first switching signal S1 and a second switching signal S2 and outputs the first square wave voltage $V_{AB}$ to the transformer 130.

The second voltage generator 120 converts the direct current power voltage $V_{in}$ to a second square wave voltage $V_{CD}$ having a different phase from a phase of the first square wave voltage $V_{AB}$ in response to a third switching signal S3 and a fourth switching signal S4 and outputs the second square wave voltage $V_{CD}$ to the transformer 130.

The first voltage generator 110 includes a first switching transistor T1, a second switching transistor T2, a first diode D1 and a second diode D2. The first switching transistor T1 includes an input electrode connected to a first node A to which the direct current power voltage $V_{in}$ is applied, a control electrode which receives the first switching signal S1 and an output electrode connected to a first input terminal IN1 of the transformer 130.

The second switching transistor T2 includes an input electrode connected to the output electrode of the first switching transistor T1, a control electrode which receives the second switching signal S2 and an output electrode connected to a second node B to which a ground voltage is applied.

As shown in FIG. 2, the first switching signal S1 has a phase which is inverted with respect to a phase of the second switching signal S2. Further, in an exemplary embodiment of the present invention, the first switching signal S1 and the second switching signal S2 each have a respective duty ratio of about 50%, as illustrated in FIG. 2.

Referring back to FIG. 1, the first switching transistor T1 is turned on by the first switching signal S1, and the direct current power voltage $V_{in}$ is thereby applied to the output electrode of the first switching transistor T1. When the first switching transistor T1 is turned off and the second switching transistor T2 is turned on in response to the second switching signal S2, an electric potential of the output electrode of the first switching transistor T1 decreases to the ground voltage. As a result, the first voltage generator 110 has an electric potential equal to an electrical potential of the direct current power voltage $V_{in}$ during a high period of the first switching signal S1, and outputs the first square wave voltage $V_{AB}$ which is subsequently decreased to the ground voltage during subsequent a high period of the second switching signal S2. The first square wave voltage $V_{AB}$ output from the first voltage generator 110 is applied to the first input terminal IN1 of the transformer 130.

The first diode D1 of the first voltage generator 110 includes an anode connected to the output electrode of the first switching transistor T1 and a cathode connected to the first node A. The second diode D2 of the first voltage generator 110 includes an anode connected to the second node B and a cathode connected to the input electrode of the second switching transistor T2. The first diode D1 and the second diode D2 are each reverse biased to prevent a counter current from being applied to the first switching transistor T1 and the second switching transistor T2, respectively.

The second voltage generator 120 includes a third switching transistor T3, a fourth switching transistor T4, a third diode D3 and a fourth diode D4. The third switching transistor T3 includes an input electrode connected to a third node C to which the direct current power voltage $V_{in}$ is applied, a control electrode which receives the third switching signal S3 and an output electrode connected to a second input terminal IN2 of the transformer 130. The fourth switching transistor T4 includes an input electrode connected to the output electrode of the third switching transistor T3, a control electrode which receives the fourth switching signal S4 and an output electrode connected to a fourth node D to which the ground voltage is applied.

The third diode D3 of the second voltage generator 120 includes an anode connected to the output electrode of the third switching transistor T3 and a cathode connected to the third node C. The fourth diode D4 of the second voltage generator 120 includes an anode connected to the fourth node D and a cathode connected to the input electrode of the fourth switching transistor T4. The third diode D3 and the fourth diode D4 are each reverse biased to prevent a counter current from being applied to the third switching transistor T3 and the fourth switching transistor T4, respectively.

As shown in FIG. 2, the third switching signal S3 has a phase which is delayed from the phase of the first switching signal S1 by a predetermined amount of time t1, and the fourth switching signal S4 has a phase which is inverted with respect to the phase of the third switching signal S3. In an exemplary embodiment of the present invention, a high period of the first switching signal S1 partially overlaps a high period of the third switching signal S3, and the high period of the second switching signal S2 partially overlaps a high period of the fourth switching signal S4, as shown in FIG. 2. Further, each of the first to fourth switching signals S1, S2, S3 and S4, respectively, has a duty ratio of about 50%, but are not limited thereto in alternative exemplary embodiments.

Referring again to FIG. 1, the third switching transistor T3 is turned on by the third switching signal S3, and the direct current power voltage $V_{in}$ is thereby applied to the output electrode of the third switching transistor T3. When the third switching transistor T3 is subsequently turned off and the fourth switching transistor T4 is turned on in response to the fourth switching signal S4, an electric potential of the output electrode of the third switching transistor T3 is decreased to the ground voltage. As a result, the second voltage generator 120 has an electric potential equal to an electrical potential of the direct current power voltage $V_{in}$ during the high period of the third switching signal S3, and outputs the second square wave voltage $V_{CD}$ which is decreased to the ground voltage during the high period of the fourth switching signal S4. The second square wave voltage $V_{CD}$ output from the second voltage generator 120 is applied to the second input terminal IN2 of the transformer 130.

The second square wave voltage $V_{CD}$ output from the second voltage generator 120 has a phase which is delayed from a phase of the first square wave voltage $V_{AB}$ by a predetermined time. For example, a phase difference between the first square wave voltage $V_{AB}$ and the second square wave voltage $V_{CD}$ is equal to a phase difference between the first switching signal S1 and the third switching signal S3 due to the predetermined amount of time t1 shown in FIG. 2.

Since the first square wave voltage $V_{AB}$ and the second square wave voltage $V_{CD}$ are applied to the first input terminal IN1 and the second input terminal IN2 of the transformer 130, respectively, a first driving voltage $V_P$ of the transformer 130 is determined by an electric potential difference between the first square wave voltage $V_{AB}$ and the second square wave voltage $V_{CD}$.

Referring to FIG. 2, the first driving voltage $V_P$ has an electric potential equal to an electric potential of the direct current power voltage $V_{in}$ during a first period P1 (FIG. 2) where the high period of the first switching signal S1 overlaps a low period of the third switching signal S3, and has an electric potential $-V_{in}$ having a polarity opposite to a polarity of the direct current power voltage $V_{in}$ during a second period P2 where a low period of the first switching signal S1 overlaps the high period of the third switching signal S3. Further, the first driving voltage $V_P$ has an electric potential of about 0V during a third period P3 where the high period of the first switching signal S1 overlaps the high period of the third switching signal S3 and a fourth period P4 where the low period of the first switching signal S1 overlaps the low period of the third switching signal S3, as shown in FIG. 2.

Referring again to FIG. 1, the transformer 130 boosts the first driving voltage $V_P$ to a second driving voltage $V_{Lamp}$ having a voltage level greater than a voltage level of the first driving voltage $V_P$ and provides the boosted second driving voltage $V_{Lamp}$ to a lamp. The lamp emits a light in response to the second driving voltage $V_{Lamp}$.

As shown in FIGS. 1 and 2, the lamp driving circuit 100 generates the first driving voltage $V_P$ applied to the transformer 130 using respective phase differences between the first through fourth switching signals S1-S4, respectively.

Figure 3:
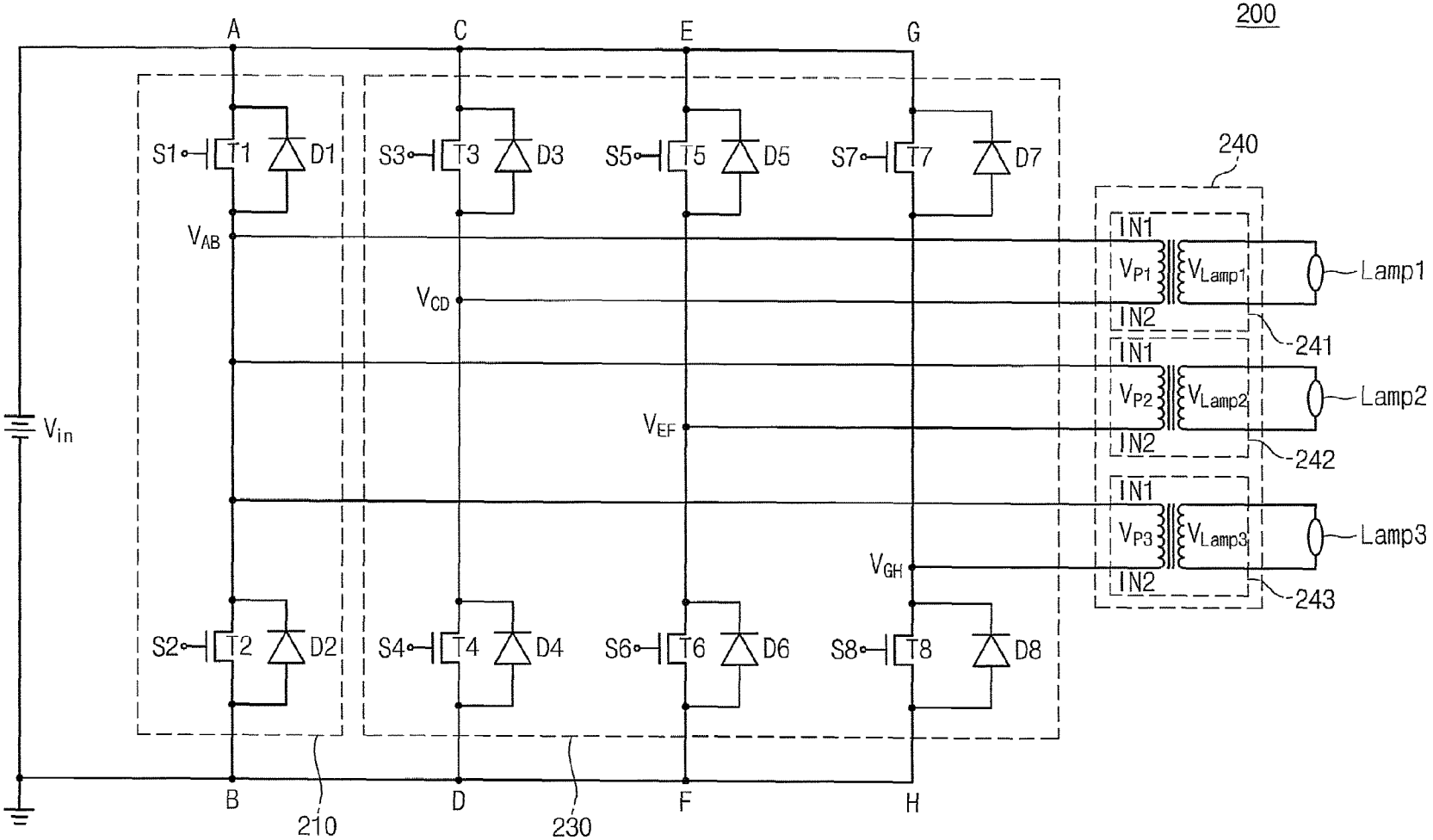
FIG. 3 is a schematic circuit diagram of a lamp driving circuit according to an alternative exemplary embodiment of the present invention.

FIG. 3 is a schematic circuit diagram of a lamp driving circuit according to an alternative exemplary embodiment of the present invention.

Referring to FIG. 3, a lamp driving circuit 200 includes a first voltage generator 210, a second voltage generator 230 and a boosting part 240. The first voltage generator 210 has the same configuration as the first voltage generator 110 described in greater detail above with reference to FIG. 1, and thus any repetitive description thereof will hereinafter be omitted.

The boosting part 240 includes a first transformer 241, a second transformer 242 and a third transformer 243. A first input terminal IN1 of each of the first to third transformers 241, 242 and 243, respectively, are commonly connected to an output terminal (e.g., an output electrode of a first switching transistor T1) of the first voltage generator 210.

The second voltage generator 230 includes a third switching transistor T3, a fourth switching transistor T4, a fifth switching transistor T5, a sixth switching transistor T6, a seventh switching transistor T7, an eighth switching transistor T8, a third diode D3, a fourth diode D4, a fifth diode D5, a sixth diode D6, a seventh diode D7 and an eighth diode D8.

The third switching transistor T3 includes an input electrode connected to a third node C to which a direct current power voltage $V_{in}$ is applied, a control electrode which receives a third switching signal S3 and an output electrode connected to a second input terminal IN2 of the first transformer 241. The fourth switching transistor T4 includes an input electrode connected to the output electrode of the third switching transistor T3, a control electrode which receives a fourth switching signal S4, and an output electrode connected to a fourth node D to which a ground voltage is applied.

The third diode D3 of the second voltage generator 230 includes an anode connected to the output electrode of the third switching transistor T3 and a cathode connected to the third node C. The fourth diode D4 of the second voltage generator 230 includes an anode connected to the fourth node D and a cathode connected to the input electrode of the fourth switching transistor T4. The third diode D3 and the fourth diode D4 are each reverse biased to prevent a counter current from being applied to the third switching transistor T3 and the fourth switching transistor T4, respectively.

The fifth switching transistor T5 includes an input electrode connected to a fifth node E to which the direct current power voltage $V_{in}$ is applied, a control electrode which receives a fifth switching signal S5 and an output electrode connected to a second input terminal IN2 of the second transformer 242. The sixth switching transistor T6 includes an input electrode connected to the output electrode of the fifth switching transistor T5, a control electrode which receives a sixth switching signal S6, and an output electrode connected to a sixth node F to which the ground voltage is applied.

The fifth diode D5 of the second voltage generator 230 includes an anode connected to the output electrode of the third fifth transistor T5 and a cathode connected to the fifth node E. The sixth diode D6 of the second voltage generator 230 includes an anode connected to the sixth node F and a cathode connected to the input electrode of the sixth switching transistor T6. The fifth diode D5 and the sixth diode D6 are each reverse biased to prevent a counter current from being applied to the fifth switching transistor T5 and the sixth switching transistor T6, respectively.

The seventh switching transistor T7 includes an input electrode connected to a seventh node G to which the direct current power voltage $V_{in}$ is applied, a control electrode which receives a seventh switching signal S7 and an output electrode connected to a second input terminal IN2 of the third transformer 243. The eighth switching transistor T8 includes an input electrode connected to the output electrode of the second switching transistor T7, a control electrode which receives an eighth switching signal S8 and an output electrode connected to an eighth node H to which the ground voltage is applied.

The seventh diode D7 of the second voltage generator 230 includes an anode connected to the output electrode of the seventh transistor T7 and a cathode connected to the seventh node G. The eighth diode D8 of the second voltage generator 230 includes an anode connected to the eighth node H and a cathode connected to the input electrode of the sixth switching transistor T6. The seventh diode D7 and the eighth diode D8 are each reverse biased to prevent a counter current from being applied to the seventh switching transistor T7 and the eighth switching transistor T8, respectively.

Still referring to FIG. 3, the first voltage generator 210 outputs a first square wave voltage $V_{AB}$ which serves as a reference voltage in response to the first switching signal S1 and the second switching signal S2. The second voltage generator 230 also outputs a second square wave voltage $V_{CD}$, a third square wave voltage $V_{EF}$ and a fourth square wave voltage $V_{GH}$, which are each shifted by a predetermined amount from the first square wave voltage $V_{AB}$ in response to the third to eighth switching signals S3-S8, respectively.

More specifically, the third switching signal S3 has a phase which is shifted by a predetermined period with respect to the first switching signal S1, and the fourth switching signal S4 has a phase which is inverted with respect to the phase of the third switching signal S3. Further, in an exemplary embodiment of the present invention, the fifth and seventh switching signals S5 and S7, respectively, have the same phase as the phase of the third switching signal S3, and the sixth and eighth switching signals S6 and S8, respectively, have the same phase as the phase of the fourth switching signal S4. Finally, the second square wave voltage $V_{CD}$, the third square wave voltage $V_{EF}$ and the fourth square wave voltage $V_{GH}$ each have the same phase.

Consequently, a first driving voltage $V_{P1}$ defined by an electric potential difference between the first square wave voltage $V_{AB}$ and the second square wave voltage $V_{CD}$, a second driving voltage $V_{P2}$ defined by an electric potential between the first square wave voltage $V_{AB}$ and the third square wave voltage $V_{EF}$, and a third driving voltage $V_{P3}$ defined by an electric potential difference between the first square wave voltage $V_{AB}$ and the fourth square wave voltage $V_{EF}$ each have equal phases, equal amplitudes and equal respective pulse widths.

The first to third transformers 241, 242 and 243, respectively, receive the first to third driving voltages $V_{P1}$, $V_{P2}$ and $V_{P3}$, respectively, to boost the first to third driving voltages $V_{P1}$, $V_{P2}$ and $V_{P3}$, respectively, to a fourth driving voltage $V_{Lamp1}$, a fifth driving voltage $V_{Lamp2}$ and a sixth driving voltage $V_{Lamp3}$, respectively, each having a higher voltage level than a respective voltage level of the first to third driving voltages $V_{P1}$, $V_{P2}$ and $V_{P3}$, respectively. The first to third transformers 241, 242 and 243, respectively, are connected to a first lamp Lamp1, a second lamp Lamp2 and a third lamp Lamp3, respectively. Thus, the first to third lamps Lamp1, Lamp2 and Lamp3 emit the light in response to the fourth to sixth driving voltages $V_{Lamp1}$, $V_{Lamp2}$ and $V_{Lamp3}$ that are output from the first to third transformers 241, 242 and 243, respectively.

Hereinafter, pulse width variations of the first to third driving voltages $V_{P1}$, $V_{P2}$ and $V_{P3}$ according to phase shifts of the third, fifth and seventh switching signals S3, S5 and S7 with respect to the first switching signal S1 will be described in further detail with reference to FIGS. 4 and 5.

Figure 4:
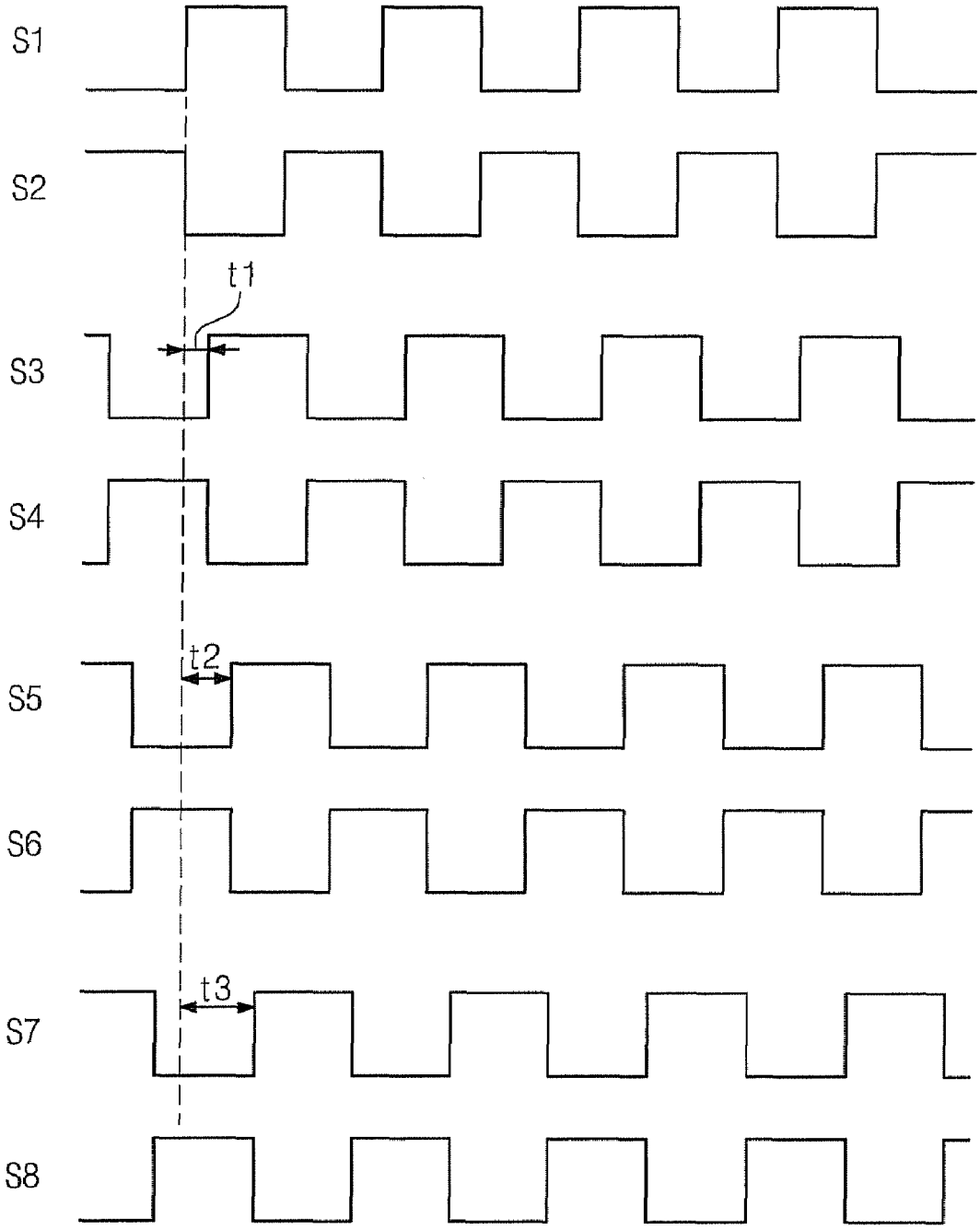
FIG. 4 is a waveform timing diagram showing switching signals of a lamp driving circuit according to the alternative exemplary embodiment of the present invention in FIG. 3.
Figure 5:
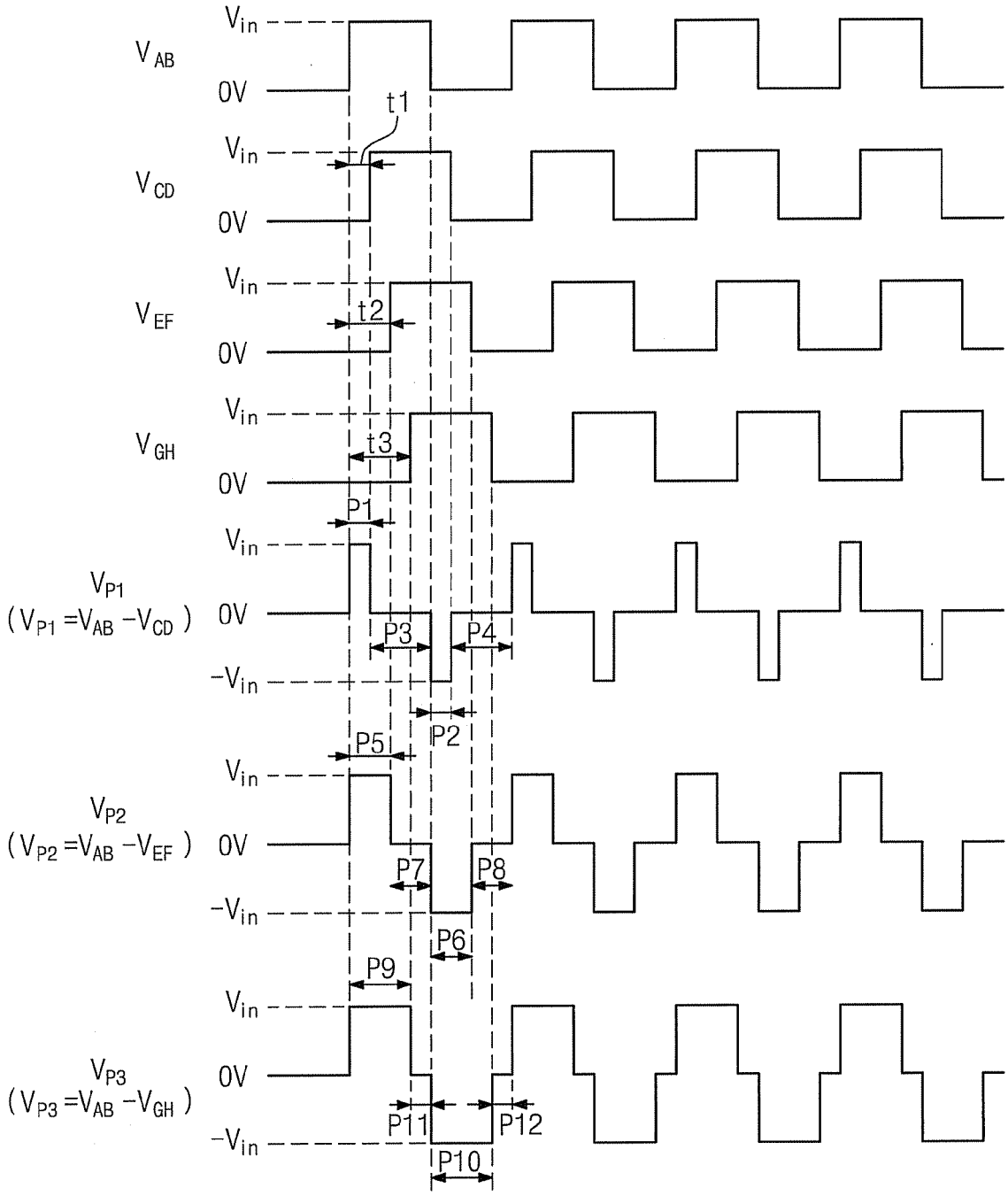
FIG. 5 is a waveform timing diagram showing square wave voltages and driving voltages of a lamp driving circuit according to the alternative exemplary embodiment of the present invention in FIG. 3.

FIG. 4 is a timing waveform diagram showing switching signals of a lamp driving circuit according to the alternative exemplary embodiment of the present invention in FIG. 3, and FIG. 5 is a waveform timing diagram showing square wave voltages and driving voltages of a lamp driving circuit according to the alternative exemplary embodiment of the present invention in FIG. 3.

Referring to FIG. 4, the first switching signal S1 has a phase which is inverted with respect to a phase of the second switching signal S2. In an exemplary embodiment, each of the first and second switching signals S1 and S2, respectively, has a duty ratio of about 50%, but are not limited thereto.

The third switching signal S3 is delayed from the first switching signal S1 by a first time t1, and the fourth switching signal S4 has a phase which is inverted with respect to a phase of the third switching signal S3. According to an exemplary embodiment the present invention, a high period of the first switching signal S1 partially overlaps a high period of the third switching signal S3, and a high period of the second switching signal S2 partially overlaps a high period of the fourth switching signal S4. Further, periods of each of the third switching signal S3 and the fourth switching signal S4 are equal to respective periods of each of the first switching signal S1 and the second switching signal S2, and the third switching signal S3 and the fourth switching signal S4 each has a duty ratio of about 50%.

The fifth switching signal S5 is delayed from the first switching signal S1 by a second time t2 which is longer than the first time t1, as shown in FIG. 4, and the sixth switching signal S6 has a phase which is inverted with respect to a phase of the fifth switching signal S5. The high period of the first switching signal S1 partially overlaps a high period of the fifth switching signal S5, and the high period of the second switching signal partially overlaps a high period of the sixth switching signal S6. Further, respective periods of the fifth switching signal S5 and the sixth switching signal S6 are equal to periods of each of the first switching signal S1 and the second switching signal S2, and the fifth switching signal S5 and the sixth switching signal S6 each has a duty ratio of about 50%.

Similarly, the seventh switching signal S7 is delayed from the first switching signal S1 by a third time t3 which is longer than the second time t2, and the eighth switching signal S8 has a phase which is inverted with respect to a phase of the seventh switching signal S7. The high period of the first switching signal S1 partially overlaps a high period of the seventh switching signal S7, and the high period of the second switching signal S2 partially overlaps a high period of the eighth switching signal S8. Further, respective periods of the seventh switching signal S7 and the eighth switching signal S8 are equal to periods of the first switching signal S1 and the second switching signal S2, and seventh switching signal S7 and the eighth switching signal S8 each has a duty ratio of about 50%, as shown in FIG. 4.

Referring to FIGS. 3 and 5, the first voltage generator 210 outputs the first square wave voltage $V_{AB}$ in response to the first and second switching signals S1 and S2, respectively. The second voltage generator 230 outputs the second square wave voltage $V_{CD}$ delayed from the first square wave voltage $V_{AB}$ by the first time t1 in response to the third and fourth switching signals S3 and S4, respectively, the third square wave voltage $V_{EF}$ which is delayed from the first square wave voltage $V_{AB}$ by the second time t2 in response to the fifth and sixth switching signals S5 and S6, respectively, and the fourth square wave voltage $V_{GH}$ which is delayed from the first square wave voltage $V_{AB}$ by the third time t3 in response to the seventh and eighth switching signals S7 and S8, respectively.

The first square wave voltage $V_{AB}$ output from the first voltage generator 210 is applied to first input terminals IN1 of each of the first to third transformers 241, 242 and 243, respectively, and the second to fourth square wave voltages $V_{CD}$, $V_{EF}$ and $V_{GH}$, respectively, output from the second voltage generator 230 are applied to second input terminals IN2 of each of the first to third transformers 241, 242 and 243, respectively.

Thus, the first driving voltage $V_{P1}$ defined by an electric potential difference between the first square wave voltage $V_{AB}$ and the second square wave voltage $V_{CD}$ serves as an input voltage of the first transformer 241, the second driving voltage $V_{P2}$ defined by an electric potential difference between the first square wave voltage $V_{AB}$ and the third square wave voltage $V_{EF}$ serves as an input voltage of the second transformer 242, and the third driving voltage $V_{P3}$ defined by an electric potential difference between the first square wave voltage $V_{AB}$ and the fourth square wave voltage $V_{GH}$ serves as an input voltage of the third transformer 243.

The first driving voltage V P1 has an electric potential equal to an electric potential of the direct current power voltage $V_{in}$ during a first period P1 where the high period of the first switching signal S1 overlaps a low period of the third switching signal S3, and has an electric potential $-V_{in}$ having an opposite polarity with respect to a polarity of the direct current power voltage $V_{in}$ during a second period P2 where a low period of the first switching signal S1 overlaps the high period of the third switching signal S3. In addition, the first driving voltage $V_{P1}$ has an electric potential of about 0V during a third period P3 where the high period of the first switching signal S1 overlaps the high period of the third switching signal S3 and a fourth period P4 where the low period of the first switching signal S1 is overlapped with the low period of the third switching signal S3.

The second driving voltage $V_{P2}$ has an electric potential equal to the electric potential of the direct current power voltage $V_{in}$ during a fifth period P5 where the high period of the first switching signal S1 overlaps a low period of the fifth switching signal S5, and has an electric potential $-V_{in}$ having an opposite polarity to the polarity of the direct current power voltage $V_{in}$ during a sixth period P6 where the low period of the first switching signal S1 overlaps the high period of the fifth switching signal S5. Further, the second driving voltage $V_{P2}$ has an electric potential of about 0V during a seventh period P7 where the high period of the first switching signal S1 overlaps the high period of the fifth switching signal S5 and an eighth period P8 where the low period of the first switching signal S1 overlaps the low period of the fifth switching signal S5.

Likewise, the third driving voltage $V_{P3}$ has an electric potential equal to the electric potential of the direct current power voltage $V_{in}$ during a ninth period P9 where the high period of the first switching signal S1 overlaps a low period of the seventh switching signal S7, and has an electric potential $-V_{in}$ having an opposite polarity to the polarity of the direct current power voltage $V_{in}$ during a tenth period P10 where the low period of the first switching signal S1 overlaps the high period of the seventh switching signal S7. Finally, the third driving voltage $V_{P3}$ has an electric potential of about 0V during an eleventh period P11 where the high period of the first switching signal S1 overlaps the high period of the seventh switching signal S7 and a twelfth period P12 where the low period of the first switching signal S1 overlaps the low period of the seventh switching signal S7.

Thus, pulse widths of each of the fifth period P5 and the sixth period P6 of the second driving voltage $V_{P2}$ are wider than pulse widths of each of the first period P1 and the second period P2 of the first driving voltage $V_{P1}$, and pulse widths of each of the ninth period P9 and the tenth period P10 of the third driving voltage $V_{P3}$ are wider than pulse widths of each of the fifth period P5 and the sixth period P6 of the second driving voltage $V_{P2}$.

Referring back to FIG. 3, the first to third transformers 241, 242 and 243, respectively, receive the first to third driving voltages $V_{P1}$, $V_{P2}$ and $V_{P3}$, respectively, to output the fourth to sixth driving voltages $V_{Lamp1}$, $V_{Lamp2}$ and $V_{Lamp3}$, respectively, each having higher voltage levels than voltage levels of each of the first to third driving voltages $V_{P1}$, $V_{P2}$ and $V_{P3}$, respectively. The fourth to sixth driving voltages $V_{Lamp1}$, $V_{Lamp2}$ and $V_{Lamp3}$, respectively, are applied to the first to third lamps Lamp1, Lamp2 and Lamp3, respectively. Thus, the first to third lamps Lamp1, Lamp2 and Lamp3, respectively, emit light in response to the fourth to sixth driving voltages $V_{Lamp1}$, $V_{Lamp2}$ and $V_{Lamp3}$, respectively.

As shown in FIG. 3, the lamp driving circuit 200 adopts a phase shift modulation method wherein the third, fifth and seventh switching signals S3, S5 and S7, respectively, shift by a predetermined phase with respect to the first switching signal S1 to generate the first to third square wave voltages $V_{AB}$, $V_{CD}$ and $V_{EF}$, respectively.

Therefore, the first input terminals IN1 of each of the first to third transformers 241, 242 and 243, respectively, are commonly connected to the first voltage generator 210 to each receive the first square wave voltage $V_{AB}$. The lamp driving circuit 200 includes only two switching transistors, e.g., the first switching transistor T1 and the second switching transistor T2, to provide the first square wave voltage $V_{AB}$ to the first input terminals IN1 of each of the first to third transformers 241, 242 and 243, respectively. Consequently, a total number of transistors of the lamp driving circuit 200 is effectively decreased or substantially reduced, thereby simplifying a circuit configuration of the lamp driving circuit 200 according to an exemplary embodiment of the present invention.

Figure 6:
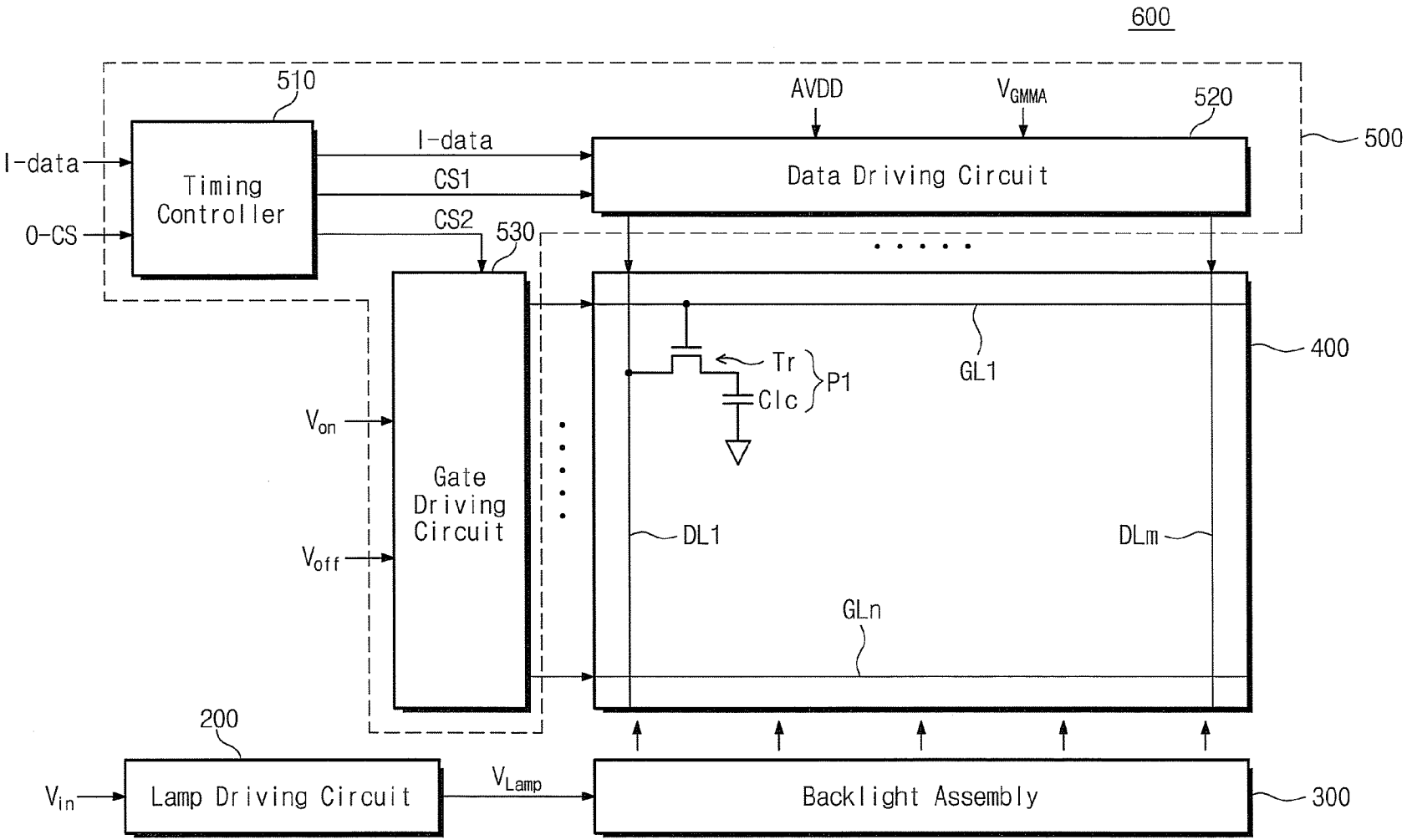
FIG. 6 is a block diagram of a liquid crystal display according to an exemplary embodiment of the present invention.

FIG. 6 is a block diagram of a liquid crystal display according to an exemplary embodiment of the present invention.

Referring to FIG. 6, a liquid crystal display 600 includes a lamp driving circuit 200, a backlight assembly 300, a display panel 400 and a panel driving circuit 500.

The lamp driving circuit 200 in FIG. 6 has the same configuration as the lamp driving circuit 100 described in greater detail above with reference to FIG. 1) and/or the lamp driving circuit 200 described in greater detail above with reference to FIG. 3, and any repetitive description thereof will hereinafter be omitted.

The lamp driving circuit 200 outputs a second driving voltage $V_{Lamp}$ in response to a direct current power voltage $V_{in}$, as described in greater detail above.

The backlight assembly 300 includes at least one lamp (not shown) which emits light. The lamp emits the light in response to the second driving voltage $V_{Lamp}$, and the emitted light is supplied to the display panel 400.

The panel driving circuit 500 includes a timing controller 510, a data driving circuit 520 and a gate driving circuit 530.

The timing controller 510 receives an image data I-data and a control signal O-CS from an outside device (not shown). The timing controller 510 converts the control signal O-CS to a data control signal CS1 and a gate control signal CS2 and outputs the data control signal CS1 and the gate control signal CS2. The data driving circuit 520 receives a supply voltage AVDD and the image data I-data from the timing controller 510 in synchronization with the data control signal CS1. The data driving circuit 520 changes the image data I-data to a data voltage (not shown) corresponding to the image data I-data based on a gamma reference voltage $V_{GMMA}$, and outputs the data voltage to a plurality of data lines DL1-DLm.

The gate driving circuit 530 receives a gate-on voltage Von and a gate-off voltage Voff and generates a gate signal (not shown) generated as the gate-on voltage Von in response to the gate control signal CS2. The gate signal is sequentially applied to a plurality of gate lines GL1-GLn.

The display panel 400 includes an array substrate (not shown), an opposite substrate (not shown) facing the array substrate, and a liquid crystal layer (not shown) interposed between the array substrate and the opposite substrate. The array substrate includes the plurality of gate lines GL1-GLn and the plurality of data lines DL1-DLm, each data line of which is insulated from and intersects respective gate lines of the plurality of gate lines GL1-GLn. The array substrate includes a plurality of pixel areas disposed in a substantially matrix pattern by the plurality of gate lines GL1-GLn and the plurality of data lines DL1-DLm, and a plurality of pixels arranged in pixel areas of the plurality of pixel areas. Each pixel of the plurality of pixels includes a thin film transistor Tr and a liquid crystal capacitor Clc.

The thin film transistor Tr arranged in, e.g., a first pixel P1 of the plurality of pixels includes a gate electrode connected to a first gate line GL1, a source electrode connected to a first data line DL1, and a drain electrode connected to a pixel electrode (not shown) which serves as a first electrode of the liquid crystal capacitor Clc. Thus, the thin film transistor Tr outputs the data voltage applied through the first data line DL1 to the pixel electrode in response to the gate signal applied through the first gate line GL1.

Meanwhile, a second electrode of the liquid crystal capacitor Clc is a common electrode facing the pixel electrode, and a common voltage (not shown) is applied to the common electrode. Thus, an alignment of liquid crystal molecules (not shown) disposed between the pixel electrode and the common electrode is determined by an electric field formed between the pixel electrode and the common electrode and a transmittance of the light provided from the backlight assembly 300 is thereby controlled. As a result, an image is displayed on the display panel 400.

When a number of lamps Num1 arranged in the backlight assembly 300 is increased to improve a brightness of the liquid crystal display 600, a total number of switching transistors Num2 arranged in the lamp driving circuit 200 with respect to the number of lamps Num1 is determined according to Equation 1.

$$Num2=2*Num1+2 \qquad \text{Equation 1}$$

where Num2 is the number of switching devices and Num1 is the number of lamps.

Thus, in an exemplary embodiment of the present invention, a total number of switching transistors arranged in the lamp driving circuit 200 is effectively reduced in the simplified circuit configuration of the lamp driving circuit 200 described above in greater detail.

Therefore, according to exemplary embodiments of the present invention described herein, the phase of the third switching signal and the fourth switching signal are shifted based on the first switching signal and the second switching signal and the second square wave voltage having the shifted phase with respect to the first square wave voltage is generated.

Thus, the first driving voltage defined by the electric potential difference between the first square wave voltage and the second square wave voltage is boosted to the second driving voltage, and the boosted second driving voltage is applied to the lamp, thereby effectively decreasing the number of switching devices required in the lamp driving circuit. As a result, the lamp driving circuit has the simplified circuit configuration.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes and modifications in form and details may be made therein by those of ordinary skill in the art without departing from the spirit or scope of the present invention as defined by the following claims.

What is claimed is:

1. A lamp driving circuit comprising:

a first voltage generator which receives a direct current power voltage and outputs a first square wave voltage through a first output terminal in response to a first switching signal and a second switching signal having a phase which is inverted with respect to a phase of the first switching signal;

a second voltage generator which receives the direct current power voltage and outputs n ($n \geqq 2$) second square wave voltages through corresponding n second output terminals, each n second square wave voltage having a phase different than the phase of the first square wave voltage, in response to n third switching signals shifted by a predetermined time with respect to the phase of the first switching signal, and n fourth switching signals each having a phase which is inverted with respect to a corresponding phase of the n third switching signals; and a boosting part having n transformers, wherein n first input terminals of the n transformers are commonly connected to the first output terminal of the first voltage generator, n second input terminals of the n transformers are connected to respective n second output terminals of the second voltage generator, and each of the n transformers boosts a first driving voltage defined by an electric potential difference between the first square wave voltage and the corresponding second square wave voltage to a second driving voltage having a voltage level greater than a voltage level of the first driving voltage and applies the second driving voltages to a corresponding lamp.

2. The lamp driving circuit of claim 1, wherein the n third switching signals each have a phase shifted by a predetermined time with respect to the phase of the first switching signal and have a same phase, and the n fourth switching signals each have a phase which is inverted with respect to a phase of a corresponding n-th third switching signal and have a same phase.

3. The lamp driving circuit of claim 1, wherein the first driving voltages has a pulse width adjusted by a phase difference between a corresponding n-th third switching signal and the first switching signal.

4. The lamp driving circuit of claim 1, wherein the first voltage generator comprises:

a first switching device having an input electrode which receives the direct current power voltage, a control electrode which receives the first switching signal and an output electrode connected to each of the n first input terminals of the n transformers of the boosting part; and a second switching device having an input electrode connected to each of the n first input terminals of the n transformers of the boosting part, a control electrode which receives the second switching signal and an output electrode connected to a ground voltage terminal to which a ground voltage is applied.

5. The lamp driving circuit of claim 4, wherein the second voltage generator comprises:

n third switching devices, each having an input electrode which receives the direct current power voltage, a control electrode which receives a corresponding n-th third switching signal and an output electrode connected to a respective second input terminal of the n transformers of the boosting part; and n fourth switching devices each having an input electrode connected to a respective second input terminal of the n transformers of the boosting part, a control electrode which receives a corresponding n-th fourth switching signal and an output electrode connected to the ground voltage terminal to which the ground voltage is applied.

6. The lamp driving circuit of claim 1, wherein a high period of the first switching signal partially temporally overlaps a respective high period of each of the n third switching signals and a high period of the second switching signal partially temporally overlaps a respective high period of each of the n fourth switching signals.

7. The lamp driving circuit of claim 6, wherein a pulse width of the first driving voltage is determined by a width of a first period where a high period of the first switching signal temporally overlaps a high period of a respective n-th third switching signal and a width of a second period where a high period of the second switching signal temporally overlaps a high period of a respective n-th fourth switching signal.

8. A display apparatus comprising:

a backlight assembly having n ($n \geqq 2$) lamps, each of which emits a light;

a lamp driving circuit which drives the n lamps; and a display panel which receives the light from the backlight assembly to display an image, wherein the lamp driving circuit comprises:

a first voltage generator which receives a direct current power voltage and outputs a first square wave voltage through a first output terminal in response to a first switching signal and a second switching signal having a phase which is inverted with respect to a phase of the first switching signal;

a second voltage generator which receives the direct current power voltage and outputs n second square wave voltages through corresponding n-th second output terminals, each n second square wave voltage having a phase different than a phase of the first square wave voltage in response to n third switching signals shifted by a predetermined time with respect to the phase of the first switching signal, and n fourth switching signals each having a phase which is inverted with respect to a corresponding phase of the n third switching signals; and a boosting part having n transformers, wherein n first input terminals of the n transformers are commonly connected to the first output terminal of the first voltage generator, n second input terminals of the n transformers are connected to respective ii second output terminals of the second voltage generator, and each of the n transformers boosts a first driving voltage defined by an electric potential difference between the first square wave voltage and the corresponding second square wave voltage to a second driving voltage having a voltage level greater than a voltage level of the first driving voltage, and applies the second driving voltage to corresponding lamp.

9. The display apparatus of claim 8, wherein the n third switching signals each have a phase shifted by a predetermined time with respect to the phase of the first switching signal and have a same phase, and the n fourth switching signals each have a phase which is inverted with respect to a phase of a corresponding n-th third switching signal and have a same phase.

10. The display apparatus of claim 8, wherein a high period of the first switching signal partially temporally overlaps a respective high period of each of the n third switching signals, and a high period of the second switching signal partially temporally overlaps a respective high period of each of the n fourth switching signals.

11. The display apparatus of claim 10, wherein a pulse width of the first driving voltage is determined by a width of a first period where a high period of the first switching signal temporally overlaps a high period of a respective n-th third switching signal and a width of a second period where a high period of the second switching signal temporally overlaps a high period of a respective n-th fourth switching signal.

* * * * *